United States Patent [19]

Yamazaki et al.

[11] Patent Number: 4,673,629

[45] Date of Patent: Jun. 16, 1987

[54] PHOTORECEPTOR HAVING AMORPHOUS SILICON LAYERS

[75] Inventors: Toshinori Yamazaki; Tatsuo Nakanishi; Yuji Marukawa, all of Hachioji; Shigeki Takenouchi, Chofu; Hiroyuki Nomori, Hachioji, all of Japan

[73] Assignee: Konishiroku Photo Industry Co., Ltd., Tokyo, Japan

[21] Appl. No.: 813,619

[22] Filed: Dec. 26, 1985

[30] Foreign Application Priority Data

| | | | |
|---|---|---|---|
| Dec. 31, 1984 | [JP] | Japan | 59-277818 |
| Feb. 8, 1985 | [JP] | Japan | 60-23105 |
| Feb. 8, 1985 | [JP] | Japan | 60-23106 |
| Feb. 8, 1985 | [JP] | Japan | 60-23107 |
| Feb. 8, 1985 | [JP] | Japan | 60-23108 |

[51] Int. Cl.[4] ..... G03G 5/082

[52] U.S. Cl. ..... 430/58; 430/66; 430/67; 430/84

[58] Field of Search ..... 430/58, 57, 66, 67, 430/84; 252/501.1

[56] References Cited

U.S. PATENT DOCUMENTS

| | | | |
|---|---|---|---|
| 4,510,224 | 4/1985 | Yamazaki et al. | 430/58 |
| 4,544,617 | 10/1985 | Mort et al. | 430/58 |
| 4,557,987 | 12/1985 | Shirai et al. | 430/58 |

*Primary Examiner*—John L. Goodrow

*Attorney, Agent, or Firm*—Frishauf, Holtz, Goodman & Woodward

[57] ABSTRACT

A photoreceptor comprising a support bearing thereon a charge transport layer comprising one selected from the group consisting of a—SiC:H, a—SiC:F and a—SiC:H:F, a charge generating layer comprising one selected from the group consisting of a—SiH, a—SiF and a SiH:F, an a—Si type surface modifying layer containing one selected from the group consisting of N, O and C, and an a—Si type interlayer containing at least one selected from the group consisting of N, O and C, the content of said at least one of N, O and C in said interlayer being less than in said surface modifying layer, said interlayer being interposed between said charge generating layer and said surface modifying layer.

28 Claims, 26 Drawing Figures

FIG. 8 (b)

| SCRATCH RESISTANCE (g) | BLUR | RESIDUAL VOLTAGE (V) | 200,000 th COPY QUALITY |
|---|---|---|---|
| 2 | × | 15 | × |
| 10 | × | 20 | × |
| 15 | △ | 21 | △ |
| 40 | ○ | 23 | ○ |
| 70 | ◎ | 23 | ◎ |
| 40 | ○ | 25 | ○ |
| 20 | △ | 30 | △ |
| 80 | ◎ | 25 | ◎ |
| 80 | ◎ | 25 | ◎ |
| 15 | △ | 22 | △ |
| 40 | ◎ | 24 | ○ |
| 70 | ◎ | 25 | ◎ |
| 70 | ○ | 25 | ◎ |
| 10 | △ | 20 | △ |
| 30 | ○ | 21 | ○ |
| 70 | ◎ | 23 | ◎ |
| 75 | ◎ | 50 | ○ |
| 80 | ◎ | 85 | △ |
| 30 | ○ | 21 | △ |
| 70 | ◎ | 23 | ◎ |
| 75 | ○ | 50 | ○ |
| 80 | △ | 80 | △ |

FIG. 8

| FIG. 8(a) | FIG. 8(b) |
|---|---|

FIG. 8 (a)

| NO. | SURFACE LAYER | | | INTERLAYER | | |
|---|---|---|---|---|---|---|
| | SUBSTANCE | COMPOSITION | THICKNESS(Å) | SUBSTANCE | COMPOSITION | THICKNESS(Å) |
| 1 | NIL | ——— | ——— | NIL | ——— | ——— |
| 2 | a-SiC:H | [C]=40at% | 1500 | NIL | ——— | ——— |
| 3 | 〃 | [C]=60 〃 | 〃 | a-SiCO:H | [C+O]=20at% | 1000 |
| 4 | 〃 | [C]=60 〃 | 〃 | 〃 | [C+O]=30 〃 | 〃 |
| 5 | 〃 | [C]=60 〃 | 〃 | 〃 | [C+O]=40 〃 | 〃 |
| 6 | 〃 | [C]=60 〃 | 〃 | 〃 | [C+O]=50 〃 | 〃 |
| 7 | 〃 | [C]=60 〃 | 〃 | 〃 | [C+O]=60 〃 | 〃 |
| 8 | 〃 | [C]=60 〃 | 〃 | a-SiCO:H | [C+O]=50 〃 | 500 |
| | | | | a-SiNO:H | [N+O]=40 〃 | 500 |
| 9 | 〃 | [C]=70 〃 | 〃 | a-SiNO:H | [N+O]=50 〃 | 500 |
| | | | | a-SiCO:H | [C+O]=30 〃 | 500 |
| 10 | 〃 | [C]=30 〃 | 〃 | a-SiNO:H | [C+O]=40 〃 | 1000 |
| 11 | 〃 | [C]=50 〃 | 〃 | 〃 | [C+O]=40 〃 | 〃 |
| 12 | 〃 | [C]=60 〃 | 〃 | 〃 | [N+O]=40 〃 | 〃 |
| 13 | 〃 | [C]=80 〃 | 〃 | 〃 | [N+O]=40 〃 | 〃 |
| 14 | 〃 | [C]=60 〃 | 200 | a-SiCO:H | [C+O]=40 〃 | 1000 |
| 15 | 〃 | 〃 | 400 | 〃 | 〃 | 〃 |
| 16 | 〃 | 〃 | 1500 | 〃 | 〃 | 〃 |
| 17 | 〃 | 〃 | 5000 | 〃 | 〃 | 〃 |
| 18 | 〃 | 〃 | 7000 | 〃 | 〃 | 〃 |
| 19 | 〃 | [C]=60 〃 | 1500 | a-SiNO:H | [N+O]=40 〃 | 50 |
| 20 | 〃 | 〃 | 〃 | 〃 | 〃 | 1000 |
| 21 | 〃 | 〃 | 〃 | 〃 | 〃 | 5000 |
| 22 | 〃 | 〃 | 〃 | 〃 | 〃 | 7000 |

FIG. 9 (b)

| SCRATCH RESISTANCE (g) | BLUR | RESMDUAL VOLTAGE (V) | 200,000th COPY QUALITY |
|---|---|---|---|
| 2 | × | 15 | × |
| 10 | × | 20 | × |
| 20 | △ | 22 | ○ |
| 50 | ○ | 22 | ◎ |
| 75 | ◎ | 23 | ◎ |
| 50 | ○ | 23 | ◎ |
| 20 | △ | 25 | △ |
| 100 | ◎ | 25 | ◎ |
| 100 | ◎ | 25 | ◎ |
| 10 | △ | 22 | △ |
| 40 | ○ | 23 | ○ |
| 75 | ◎ | 23 | ◎ |
| 75 | ○ | 25 | ◎ |
| 10 | △ | 20 | △ |
| 30 | ○ | 20 | ○ |
| 75 | ◎ | 23 | ◎ |
| 85 | ◎ | 40 | ○ |
| 100 | ○ | 80 | △ |
| 30 | ○ | 21 | ○ |
| 75 | ◎ | 23 | ◎ |
| 80 | ○ | 40 | ○ |
| 85 | △ | 85 | △ |

FIG. 9

| FIG. 9(a) | FIG. 9(b) |
|---|---|

FIG. 9 (a)

| NO. | SURFACE LAYER | | | INTERLAYER | | |
|---|---|---|---|---|---|---|
| | SUBSTANCE | COMPOSITION | THICKNESS(Å) | SUBSTANCE | COMPOSITION | THICKNESS(Å) |
| 1 | NIL | ——— | ——— | NIL | ——— | ——— |
| 2 | a-SiC:H | \|C\|=40at% | 1500 | NIL | ——— | ——— |
| 3 | 〃 | \|C\|=60 〃 | 〃 | a-SiC:H | \|C\|=20at% | 1000 |
| 4 | 〃 | 〃 | 〃 | 〃 | \|C\|=30 〃 | 〃 |
| 5 | 〃 | 〃 | 〃 | 〃 | \|C\|=40 〃 | 〃 |
| 6 | 〃 | 〃 | 〃 | 〃 | \|C\|=50 〃 | 〃 |
| 7 | 〃 | 〃 | 〃 | 〃 | \|C\|=60 〃 | 〃 |
| 8 | 〃 | 〃 | 〃 | 〃 | \|C\|=50 〃 | 500 |
| | | | | 〃 | \|C\|=40 〃 | 〃 |
| 9 | 〃 | \|C\|=70 〃 | 〃 | 〃 | \|C\|=50 〃 | 〃 |
| | | | | 〃 | \|C\|=30 〃 | 〃 |
| 10 | 〃 | \|C\|=30 〃 | 〃 | 〃 | \|C\|=40 〃 | 1000 |
| 11 | 〃 | \|C\|=50 〃 | 〃 | 〃 | 〃 | 〃 |
| 12 | 〃 | \|C\|=60 〃 | 〃 | 〃 | 〃 | 〃 |
| 13 | 〃 | \|C\|=80 〃 | 〃 | 〃 | 〃 | 〃 |
| 14 | 〃 | \|C\|=60 〃 | 200 | 〃 | 〃 | 〃 |
| 15 | 〃 | 〃 | 400 | 〃 | 〃 | 〃 |
| 16 | 〃 | 〃 | 1500 | 〃 | 〃 | 〃 |
| 17 | 〃 | 〃 | 5000 | 〃 | 〃 | 〃 |
| 18 | 〃 | 〃 | 7000 | 〃 | 〃 | 〃 |
| 19 | 〃 | 〃 | 1500 | 〃 | 〃 | 50 |
| 20 | 〃 | 〃 | 〃 | 〃 | 〃 | 1000 |
| 21 | 〃 | 〃 | 〃 | 〃 | 〃 | 5000 |
| 22 | 〃 | 〃 | 〃 | 〃 | 〃 | 7000 |

FIG. 10 (b)

| SCRATCH RESISTANCE (g) | BLUR | RESMDUAL VOLTAGE (V) | 200,000th COPY QUALITY |
|---|---|---|---|
| 2 | × | 15 | × |
| 10 | × | 20 | × |
| 20 | △ | 22 | △ |
| 45 | ○ | 23 | ○ |
| 70 | ◎ | 23 | ◎ |
| 45 | ○ | 25 | ○ |
| 20 | △ | 30 | △ |
| 80 | ◎ | 24 | ◎ |
| 80 | ◎ | 24 | ◎ |
| 10 | △ | 21 | △ |
| 35 | ○ | 23 | ○ |
| 75 | ◎ | 23 | ◎ |
| 75 | ◎ | 25 | ◎ |
| 10 | △ | 20 | △ |
| 25 | ○ | 20 | ○ |
| 75 | ◎ | 23 | ◎ |
| 85 | ○ | 45 | ○ |
| 90 | ○ | 85 | △ |
| 25 | ○ | 20 | △ |
| 70 | ◎ | 22 | ◎ |
| 85 | ○ | 40 | ○ |
| 90 | △ | 80 | △ |

FIG. 10

| FIG. 10(a) | FIG. 10(b) |
|---|---|

FIG. 10 (a)

| NO. | SURFACE LAYER | | | ERLAYER | | |
|---|---|---|---|---|---|---|
| | SUBSTANCE | COMPOSITION | THICKNESS(Å) | SUBSTANCE | COMPOSITION | THICKNESS(Å) |
| 1 | NIL | —— | —— | NIL | —— | —— |
| 2 | a-SiC:H | \|C\|=40at% | 1000 | NIL | | |
| 3 | 〃 | \|C\|=60 〃 | 〃 | a-SiN:H | \|N\|=20at% | 1500 |
| 4 | 〃 | \|C\|=60 〃 | 〃 | 〃 | \|N\|=30 〃 | 〃 |
| 5 | 〃 | \|C\|=60 〃 | 〃 | 〃 | \|N\|=40 〃 | 〃 |
| 6 | 〃 | \|C\|=60 〃 | 〃 | 〃 | \|N\|=50 〃 | 〃 |
| 7 | 〃 | \|C\|=60 〃 | 〃 | 〃 | \|N\|=60 〃 | 〃 |
| 8 | 〃 | \|C\|=60 〃 | 〃 | a-SiN:H | \|N\|=50 〃 | 500 |
| | | | | a-SiO:H | \|O\|=40 〃 | 500 |
| 9 | 〃 | \|C\|=70 〃 | 〃 | a-SiO:H | \|O\|=50 〃 | 500 |
| | | | | a-SiN:H | \|N\|=30 〃 | 500 |
| 10 | 〃 | \|C\|=30 〃 | 〃 | a-SiO:H | \|O\|=40 〃 | 1500 |
| 11 | 〃 | \|C\|=50 〃 | 〃 | 〃 | \|O\|=40 〃 | 〃 |
| 12 | 〃 | \|C\|=60 〃 | 〃 | 〃 | \|O\|=40 〃 | 〃 |
| 13 | 〃 | \|C\|=80 〃 | 〃 | 〃 | \|O\|=40 〃 | 〃 |
| 14 | 〃 | \|C\|=60 〃 | 200 | a-SiN:H | \|N\|=40 〃 | 1500 |
| 15 | 〃 | 〃 | 400 | 〃 | 〃 | 〃 |
| 16 | 〃 | 〃 | 1500 | 〃 | 〃 | 〃 |
| 17 | 〃 | 〃 | 5000 | 〃 | 〃 | 〃 |
| 18 | 〃 | 〃 | 7000 | 〃 | 〃 | 〃 |
| 19 | 〃 | \|C\|=60 〃 | 1000 | a-SiO:H | \|O\|=40 〃 | 50 |
| 20 | 〃 | 〃 | 〃 | 〃 | 〃 | 1000 |
| 21 | 〃 | 〃 | 〃 | 〃 | 〃 | 5000 |
| 22 | 〃 | 〃 | 〃 | 〃 | 〃 | 7000 |

FIG. 11 (b)

| SCRATCH RESISTANCE (g) | BLUR | RESMDUAL VOLTAGE (V) | 200,000th COPY QUALITY |
|---|---|---|---|
| 2 | × | | × |
| 10 | × | | × |
| 20 | △ | | △ |
| 40 | ○ | | ○ |
| 75 | ◎ | | ◎ |
| 45 | ○ | | ○ |
| 20 | △ | | △ |
| 80 | ◎ | | ◎ |
| 80 | ◎ | | ◎ |
| 15 | △ | | △ |
| 35 | ◎ | | ○ |
| 75 | ◎ | | ◎ |
| 70 | ○ | | ◎ |
| 10 | △ | | △ |
| 25 | ○ | | ○ |
| 70 | ◎ | | ◎ |
| 80 | ◎ | | ○ |
| 80 | ◎ | | △ |
| 25 | ○ | | |
| 70 | ◎ | | ◎ |
| 80 | ○ | | ○ |
| 85 | △ | | △ |
| 100 | ◎ | | ◎ |
| | | | |

FIG. 11

| FIG. 11(a) | FIG. 11(b) |
|---|---|

FIG. 11 (a)

| NO. | SURFACE LAYER | | | ERLAYER | | |
|---|---|---|---|---|---|---|
| | SUBSTANCE | COMPOSITION | THICKNESS(Å) | SUBSTANCE | COMPOSITION | THICKNESS(Å) |
| 1 | NIL | ——— | ——— | NIL | ——— | ——— |
| 2 | a-SiN:H | \|N\|=40at% | 1500 | NIL | ——— | ——— |
| 3 | 〃 | \|N\|=60 〃 | 〃 | a-SiCO:H | \|C+O\|=20at% | 1000 |
| 4 | 〃 | \|N\|=60 〃 | 〃 | 〃 | \|C+O\|=30 〃 | 〃 |
| 5 | 〃 | \|N\|=60 〃 | 〃 | 〃 | \|C+O\|=40 〃 | 〃 |
| 6 | 〃 | \|N\|=60 〃 | 〃 | 〃 | \|C+O\|=50 〃 | 〃 |
| 7 | 〃 | \|N\|=60 〃 | 〃 | 〃 | \|C+O\|=60 〃 | 〃 |
| 8 | 〃 | \|N\|=60 〃 | 〃 | a-SiCO:H | \|C+O\|=50 〃 | 500 |
| | | | | a-SiNO:H | \|N+O\|=40 〃 | 500 |
| 9 | 〃 | \|N\|=70 〃 | 〃 | a-SiNO:H | \|N+O\|=50 〃 | 500 |
| | | | | a-SiCO:H | \|C+O\|=30 〃 | 500 |
| 10 | 〃 | \|N\|=30 〃 | 〃 | a-SiNO:H | \|N+O\|=40 〃 | 1000 |
| 11 | 〃 | \|N\|=50 〃 | 〃 | 〃 | \|N+O\|=40 〃 | 〃 |
| 12 | 〃 | \|N\|=60 〃 | 〃 | 〃 | \|N+O\|=40 〃 | 〃 |
| 13 | 〃 | \|N\|=80 〃 | 〃 | 〃 | \|N+O\|=40 〃 | 〃 |
| 14 | 〃 | \|N\|=60 〃 | 200 | a-SiCO:H | \|C+O\|=40 〃 | 1000 |
| 15 | 〃 | 〃 | 400 | 〃 | 〃 | 〃 |
| 16 | 〃 | 〃 | 1500 | 〃 | 〃 | 〃 |
| 17 | 〃 | 〃 | 5000 | 〃 | 〃 | 〃 |
| 18 | 〃 | 〃 | 7000 | 〃 | 〃 | 〃 |
| 19 | 〃 | \|C\|=60 〃 | 1500 | a-SiNO:H | \|N+O\|=40 〃 | 50 |
| 20 | 〃 | 〃 | 〃 | 〃 | 〃 | 1000 |
| 21 | 〃 | 〃 | 〃 | 〃 | 〃 | 5000 |
| 22 | 〃 | 〃 | 〃 | 〃 | 〃 | 7000 |
| 23 | 〃 | \|N\|=60 〃 | 500 | a-SiC:H | \|C\|=50 〃 | 500 |
| | | | | | \|C\|=40 〃 | 500 |
| | | | | | | |

FIG. 12(b)

| SCRATCH RESISTANCE (g) | BLUR | RESMDUAL VOLTAGE (V) | 200,000th COPY QUALITY |
|---|---|---|---|
| 2 | × | 15 | × |
| 10 | × | 20 | × |
| 15 | △ | 21 | △ |
| 35 | ○ | 22 | ○ |
| 70 | ◎ | 23 | ◎ |
| 45 | ○ | 24 | ○ |
| 20 | △ | 30 | △ |
| 80 | ◎ | 24 | ◎ |
| 80 | ◎ | 24 | ◎ |
| 15 | △ | 21 | △ |
| 35 | ◎ | 24 | ○ |
| 70 | ◎ | 24 | ◎ |
| 75 | ○ | 27 | ◎ |
| 10 | △ | 20 | △ |
| 35 | ○ | 22 | ○ |
| 75 | ◎ | 23 | ◎ |
| 75 | ◎ | 40 | ○ |
| 85 | ◎ | 90 | △ |
| 25 | ○ | 21 | △ |
| 75 | ◎ | 22 | ◎ |
| 75 | ○ | 45 | ○ |
| 85 | △ | 80 | △ |
| 100 | ◎ | 23 | ◎ |

FIG. 12

| FIG. 12(a) | FIG. 12(b) |
|---|---|

FIG. 12 (a)

| NO. | SURFACE LAYER | | | ERLAYER | | |
|---|---|---|---|---|---|---|
| | SUBSTANCE | COMPOSITION | THICKNESS(Å) | SUBSTANCE | COMPOSITION | THICKNESS(Å) |
| 1 | NIL | ——— | ——— | NIL | ——— | ——— |
| 2 | a-SiO:H | \|O\|=40at% | 1500 | NIL | ——— | ——— |
| 3 | 〃 | \|O\|=60 〃 | 〃 | a-SiCO:H | \|C+O\|=20at% | 1000 |
| 4 | 〃 | \|O\|=60 〃 | 〃 | 〃 | \|C+O\|=30 〃 | 〃 |
| 5 | 〃 | \|O\|=60 〃 | 〃 | 〃 | \|C+O\|=40 〃 | 〃 |
| 6 | 〃 | \|O\|=60 〃 | 〃 | 〃 | \|C+O\|=50 〃 | 〃 |
| 7 | 〃 | \|O\|=60 〃 | 〃 | 〃 | \|C+O\|=60 〃 | 〃 |
| 8 | 〃 | \|O\|=60 〃 | 〃 | a-SiCO:H | \|C+O\|=50 〃 | 500 |
| | | | | a-SiNO:H | \|N+O\|=40 〃 | 500 |
| 9 | 〃 | \|O\|=70 〃 | 〃 | a-SiNO:H | \|N+O\|=50 〃 | 500 |
| | | | | a-SiCO H | \|C+O\|=30 〃 | 500 |
| 10 | 〃 | \|O\|=30 〃 | 〃 | a-SiNO:H | \|N+O\|=40 〃 | 1000 |
| 11 | 〃 | \|O\|=50 〃 | 〃 | 〃 | \|N+O\|=40 〃 | 〃 |
| 12 | 〃 | \|O\|=60 〃 | 〃 | 〃 | \|N+O\|=40 〃 | 〃 |
| 13 | 〃 | \|O\|=80 〃 | 〃 | 〃 | \|N+O\|=40 〃 | 〃 |
| 14 | 〃 | \|O\|=60 〃 | 200 | a-SiCO:H | \|C+O\|=40 〃 | 1000 |
| 15 | 〃 | 〃 | 400 | 〃 | 〃 | 〃 |
| 16 | 〃 | 〃 | 1500 | 〃 | 〃 | 〃 |
| 17 | 〃 | 〃 | 5000 | 〃 | 〃 | 〃 |
| 18 | 〃 | 〃 | 7000 | 〃 | 〃 | 〃 |
| 19 | 〃 | \|O\|=60 〃 | 1500 | a-SiNO:H | \|N+O\|=40 〃 | 50 |
| 20 | 〃 | 〃 | 〃 | 〃 | 〃 | 1000 |
| 21 | 〃 | 〃 | 〃 | 〃 | 〃 | 5000 |
| 22 | 〃 | 〃 | 〃 | 〃 | 〃 | 7000 |
| 23 | 〃 | \|O\|=60 〃 | 1500 | a-SiN:H | \|N\|=50 〃 | 500 |
| | | | | | \|N\|=40 〃 | 500 |

PHOTORECEPTOR HAVING AMORPHOUS SILICON LAYERS

BACKGROUND OF THE INVENTION

This invention relates to a photoreceptor including, for example, an electrophotographic receptor.

Heretofore, there have so far been well-known electrophotographic receptors such as a photoreceptor comprising Se or Se doped with As, Te, Sb or the like, a photoreceptor comprising ZnO or CdS which is dispersed in a resin binder, and the like. However, these photoreceptors have had problems of environmental contamination, thermal instability and poor mechanical strength.

In recent years, on the other hand, there have been proposals of electrophotographic receptors using amorphous silicon (a-Si) to serve as the parent thereof. a-Si has the so-called dangling-bond when the link of Si-Si is cut-off. As the result of this disadvantage, there are many localized levels in the energy-gap in a-Si. Hopping conduction takes place in a thermoexciting carrier to reduce the dark resistance and a photoexciting carrier is trapped at the localized levels to worsen the photoconductivity. As a countermeasure, the above-mentioned dangling-bond has been filled by offsetting the above-mentioned disadvantages with a hydrogen atom (H) to be linked to Si.

The dark resistivity of such amorphous silicon hydride as mentioned above (hereinafter called a-Si:H) is from $10^8$ to $10^9$ Ω.cm, that is about one ten-thousandth lower than that of amorphous Se. Therefore, a photoreceptor comprising a single layer of a-Si:H has the problems that it has a relatively greater dark decay rate of surface potential and a relatively lower initial charged voltage. However, on the other hand, it has very excellent characteristics to serve as a light-sensitive layer of photoreceptors, because the resistivity thereof will remarkably be reduced when it is irradiated with visible and infra-red rays of light.

FIG. 14 illustrates an electrophotographic copying machine into which an a-Si type photoreceptor having the parent body of the above-mentioned a-Si is incorporated. According to the copying machine, there are arranged on the upper part of cabinet 1 thereof with a glass-made original platen 3 for placing an original document 2 thereon and a platen-cover 4 for covering the original document 2. Below the original platen 3, there is arranged an optical scanning table comprising first-mirror unit 7 provided with light source 5 and mirror 6 for first reflection so that it can reciprocate straight from side to side in the drawing, and second mirror unit 20 for fixing an original document scanning point and the optical path of the photoreceptor is moved according to the reciprocating speed of the first mirror unit 7, so that reflected light from original document platen 3 may be incident in slit-like form upon a photoreceptor drum 9 which serves as an image carrier, through lens 21 and reflection mirror 8. Around the drum 9, there are arranged with corona-charger 10, developer 11, image transfer device 12, separation device 13 and cleaning device 14, respectively. Copy papers 18 transferred from paper-feed tray 15 through each of paper feed rollers 16 and 17 and are fixed in fixing device 19 after an image registered on the drum 9 is transferred onto the copy paper 18 and then the copy paper 18 is delivered from the copying machine. In the fixing device 19, a fixing operation is made by passing the developed copy paper through between heat-roller 23 comprising a heater 22 and pressure roller 24.

However, there have not so far satisfactorily been studied the chemical stability of the surfaces of photoreceptors having the surface made of a-Si:H, such as the influence of exposing the surfaces to air and moisture for a long time, the influence of the chemical species produced by a corona-discharge on the surfaces, and the like. For example, it has already been proven that the surfaces thereof allowed to stand for not less than one month are affected by moisture and the incoming voltage thereto is also lowered seriously. On the other hand, there are descriptions in 'Phil. Mag.' Vol. 35, 1978 and the like about the preparation processes and the existence of amorphous silicon carbide, carbide hydride (hereinafter called a-SiC:H) and it has been well-known that the characteristics thereof are substantially higher in heat-resistance and surface-hardness and relatively higher in dark-resistance that is from $10^{12}$ to $10^{13}$ Ω.cm than that of a-Si:H, and also the optical energy gap thereof will be varied in accordance with the variations of the carbon content, to the extent of the range from 1.6 to 2.8 eV, while there is a disadvantage that the sensitivity thereof in long wavelengths will become poor because the band-gap thereof will be widened due to the carbon content.

Such an electrophotographic receptor combining a-SiC:H with a-Si:H is proposed in, for example, Japanese Patent Publication Open to Public Inspection (hereinafter called Japanese Patent O.P.I. Publication) No. 127083/1980. According to this Japanese Patent Publication, as improvement of the charged voltage thereof is tried in such a manner that an a-Si:H layer serves as a charge-generating (photoconductive) layer and an a-SiC:H layer is provided underneath the charge-generating layer so as to be photosensitive in a relatively wider wavelength region than the a-Si:H and the charge voltage thereof may be improved by the formation between the a-Si:H layer and the a-SiC:H of the lower layer of a hetero-junction. In such an electrophotographic receptor as described above, however, the dark-decay of the a-Si:H layer cannot be prevented satisfactorily and the charged voltage thereof is still unsatisfactory for putting into practice, and in addition, the chemical stability, mechanical strength, heat-resistance and the like thereof will become poor because an a-Si:H layer is present on the surface thereof.

In the meantime Japanese Patent O.P.I. Publication No. 17952/1982 discloses that a primary a-SiC:H layer is formed on a charge-generating layer comprising a-Si:H so as to serve as a surface modifying layer and, onto the back side thereof, i.e., on the support-electrode side, a secondary a-SiC:H layer is formed.

Further, a photoreceptor relating to the above-mentioned technology is known as described in Japanese Patent O.P.I. Publication No. 23543/1982, in which an inclined layer of a-$Si_{1-x}C_x$:H is interposed between the above-mentioned charge-generating layer and the above-mentioned primary and secondary a-SiC:H layers, and in this inclined layer, x is made to be zero (x=0) on the a-Si:H side and x is made to be 0.5 (x=0.5) on the a-SiC:H layer side.

When the inventors studied the above-mentioned well-known photoreceptors, they found that the effects of providing a surface modifying layer could not display so much particularly in a continuous repetition in use. To be more concrete, it was found that when putting such a photoreceptor into a continuous operation of from 200,000 to 300,000 copies the surface of the a-SiC layer thereof is mechanically damaged in the course of operation of the order of from 70,000 to 80,000 copies and by this damage an image defect such as white streaks and white spots are caused, so that the printing durability cannot be satisfactory. In addition to the above, the light-fastness thereof will be lowered with repeating the operation and an blur is also caused, and further the electrical and optical characteristics thereof are not stabilized at any time, and still further it cannot be neglected that such photoreceptors are affected by the conditions of the use such as temperature and humidity. Besides the above, it is required to further improve the adhesive property of a surface modifying layer to a charge-generating layer.

SUMMARY OF THE INVENTION

It is an object of the invention to provide an improved photoreceptor which is capable of resisting mechanical damage and preventing image deterioration caused by white streaks or the like by improving the printing durability of the surface layer of the photoreceptor, and which is also improved in light-fastness, blur, stability in characteristics, strength in adhesive property, and the like.

The object of the invention can be achieved by a photoreceptor comprising a support bearing thereon a charge-transfer layer comprising one selected from the group consisting of a-SiC:H, a-SiC:F and a-SiC:H:F, a charge-generating layer comprising one selected from the group consisting of a-SiH, a-SiF and a-SiH:F, and a surface modifying layer of a-Si type containing one selected from the group consisting of N, O and C, and further an interlayer of a-Si type containing one selected from the group consisting of N, O and C, which is interposed between the charge-generating layer and the surface modifying layer.

BRIEF DESCRIPTION OF THE DRAWINGS

FIGS. 1 through 9 each illustrate the examples of the invention, respectively, wherein FIGS. 1 through 3 each are cross-sectional views illustrating a-Si type photoreceptors, respectively;

FIG. 4 is a graph exhibiting the optical energy gaps of a-SiC, a-SiNO, a-SiCO, and the like;

FIG. 5 is a graph exhibiting the specific resistance of a-SiC, a-SiN, a-SiO and the like;

FIGS. 6(*a*) through 6(*c*) each are the graphs exhibiting optical energy gap of a-SiNO, a-SiN and a-SiO.

FIG. 7 illustrates a schematic cross-sectional view of a glow-discharger;

FIGS. 8 through 12 each are the charts comparing the photoreceptors with each other in the layer-arrangements and the characteristics thereof, respectively;

DESCRIPTION OF THE PREFERRED EMBODIMENTS

The invention will now be described in more detail.

According to the invention, the contents of carbon, oxygen or nitrogen atoms are increased satisfactorily in the above-mentioned surface modifying layer of the photoreceptors relating to the invention. As a result, the photoreceptors of the invention is resistant against any mechanical damage and has not any deterioration in image quality caused from white streaks or the like and enjoys excellent printing durability. In order to satisfactorily display the advantages obtained from the above-mentioned surface modifying layer which is represented by a-$Si_{1-x}C_x$, a-$Si_{1-x}O_x$ or a-$Si_{1-x}N_x$, $x \geqq 0.5 = 50$ atomic% (hereinafter 'atomic%' is called simply '%') is preferred to be held, and $0.5 \leqq x \leqq 0.8$ is more preferred and further $0.55 \leqq x \leqq 0.7$ is particularly preferred.

In the invention, the aforementioned interlayer is interposed between the surface modifying layer and the charge-generating layer, therefore, the adhesive property of the surface modifying layer to the charge-generating layer may be improved. This interlayer comprises an amorphous hydride and/or fluoride of SiCN, SiCO, SiNO, and SiCNO. The (C+N+O) content in the above-mentioned interlayer is preferably from 30 to 50% when the total number of atoms of Si, C, N and O is regarded as 100%, and more preferably from 40 to 50%. On the other hand, the C, N or O content in the surface modifying layer is preferred to be not less than 50%. As mentioned above, it is desired that the (C+N+O) content is to be less than the C, N or O content in the above-mentioned surface modifying layer.

It is more advantageous that the number of the above-mentioned interlayer is to comprise not less than two layers and the (C+N+O) content in the interlayer on the surface modifying layer side is to be more than that in the interlayer on the charge-generating layer.

As described above, the photoreceptors relating to the invention are provided with a surface modifying layer satisfactorily containing a C, N or O and an a-Si type interlayer containing at least two kinds of C, N and O on the charge-generating layer thereof. It has, therefore, been confirmed that the photoreceptors relating to the invention are excellently improved in light-fastness and on image drift, and are constantly stabilized in electrical and optical characteristics, and further do not affect the environment in use.

The invention will now be described in detail with reference to the examples.

Figure 1:
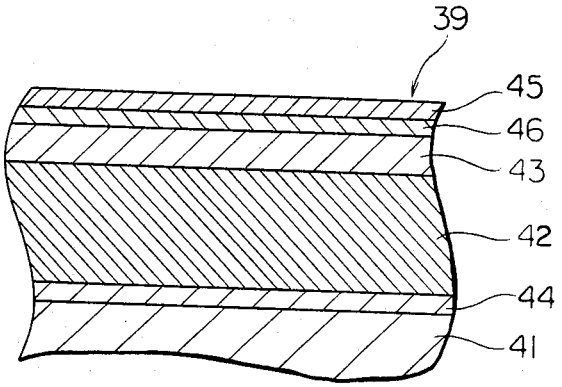

FIG. 1 illustrates an a-Si type electrophotographic receptor 39 for positively charging, embodied according to the invention. This photoreceptor 39 is constructed in such a manner that a drum-shaped conductive support 41 made of Al or the like is laminated thereon in order with a p-type charge-blacking layer 44 comprising a-SiC:H heavily doped with a IIIa group element of periodic table such as boron; a charge-transport layer 42 comprising a-SiC:H lightly doped with a IIIa group element of periodic table such as boron; a charge-generating layer 43, i.e., a photosensitive layer, comprising a-Si:H; an interlayer 46 containing amorphous silicon hydride containing C+N+O in an amount of not more than 50%, e.g., 40%, thereof; and a surface modifying layer 45 comprising amorphous silicon carbide hydride (a-$Si_{1-x}C_x$:H) containing one of C, N and O, for example, carbon atoms in an amount of not less than 50%, e.g., 60%, thereof. Such surface modifying layers comprise a-SiO:H or a-SiN:H. However, the surface modifying layer comprising a-SiC:H will be described herein. In the photosensitive layer 43, the ratio of the dark resistibility $\tau_D$ thereof to the resistibility $\tau_L$ thereof at the time of being irradiated with light is satisfactorily greater for an electrophotographic receptor use and the photosensitivity thereof particularly to visible and infra-red rays of light is excellent.

In the photoreceptor 39, according to the invention, carbon in an amount of not less than 50% of a total number of Si and C atoms is contained in surface modifying layer 45 provided on charge-generating layer 43, and an a-Si type interlayer 46 containing at least two kinds of C, N and O in an amount of not more than 50% of (C+N+O) is interposed between the two layers.

The photoreceptors constructed as mentioned above are of function-separated type for positively charging use, however, they can be modified into those for negatively charging use. If this is the case, it is required that charge-blocking layer 44 is to be heavily doped with a Va group element in periodic table such as phosphor and is then to be of n-type and further to be of $n^+$ type, and charge-transport layer 42 is not to be lightly doped with a IIIa group element in periodic table such as boron.

Figure 2:
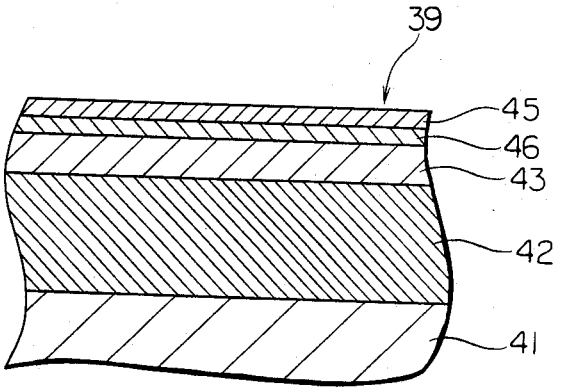
Figure 3:
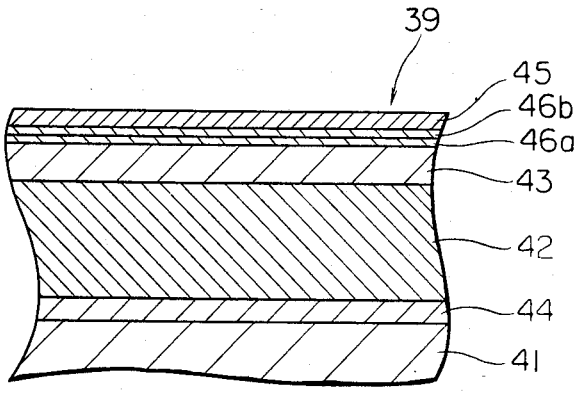

As illustrated in FIG. 2, it is also allowed not to provide any charge-blocking layer 44, and as illustrated in FIG. 3, it is advisable that the interlayer is to comprise not less than two layers, e.g., two layers 46*a* and 46*b*, and the contents of (C+N+O) in the layer 46*b* are to increase more than those in the layer 46*a*. (For example, 50% in the former layer and 40% in the latter layer.) In the case that the described interlayer comprises a plurality of layers, the effects of the invention can satisfactorily be displayed.

Figure 4:
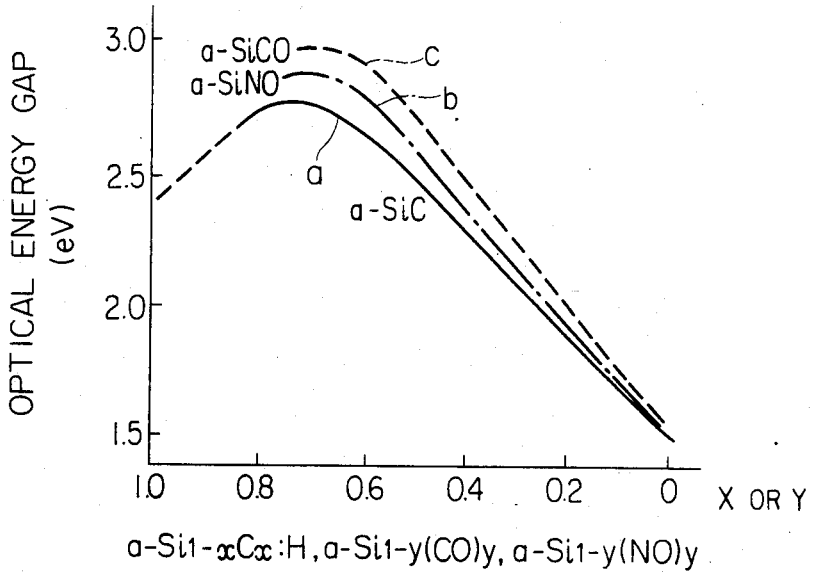

When a carbon atom content in the a-SiC:H layer, a CO content in the a-SiCO, or a NO content in the a-SiNO is within the range of from 0% to 70%, the content thereof is in an approximately linear relation to an optical energy-gap (Eg,opt), as shown in FIG. 4. It is, therefore, possible to specify the abovementioned contents if they are replaced by the corresponding optical energy-gap. With respect to a-SiCO:H and a-SiNO:H, the energy-gaps are also varied according to an amount of CO and NO, respectively.

Figure 5:
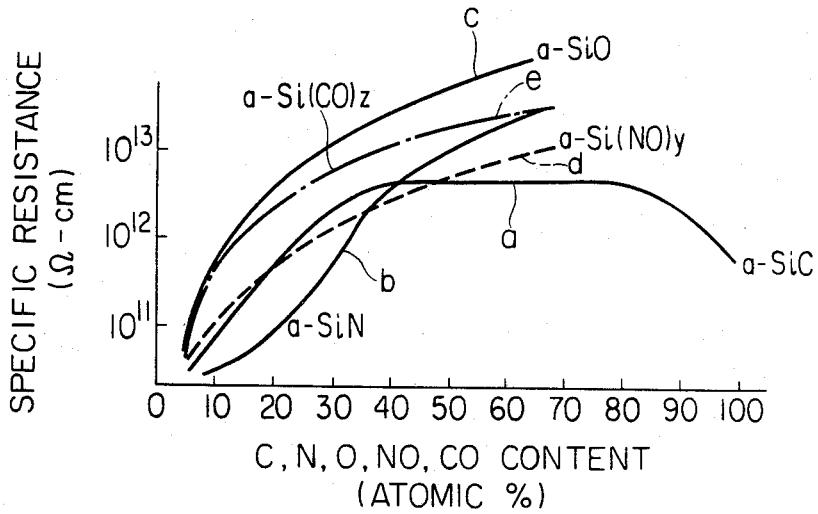

The a-SiC:H, a-SiN:H, a-SiO:H, a-SiNO:H and a-SiCO:H each may be able to display the increase in specific resistance and the improvement on the charged potential holding capability as shown by the curves a, b, c, d and e in FIG. 5, when the contents of carbon atoms, nitrogen atoms, oxygen atoms, NO or CO may suitably be adjusted. To be more concrete, as shown by the curve a in FIG. 5, for example, when using a-SiC:H containing carbon atoms in an amount of from 50 to 80% thereof, the specific resistance thereof will be varied according to the contents of carbon so as to be not less than $10^{12}$ Ω.cm. Accordingly, as mentioned above, when a carbon content in a surface modifying layer and a (C+N+O) content in an interlayer are adjusted to $0.5 \leqq x \leqq 0.8$ and $0.3 \leqq y \leqq 0.5$, respectively, the specific resistance of each layer may be satisfactorily held. If taking the curves c and b into consideration, the same may be said of the cases of a-SiO:H and a-SiN:H.

Figure 6A:
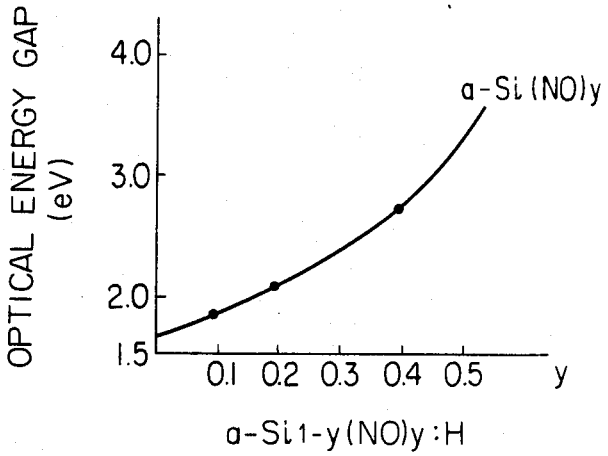
Figure 6:
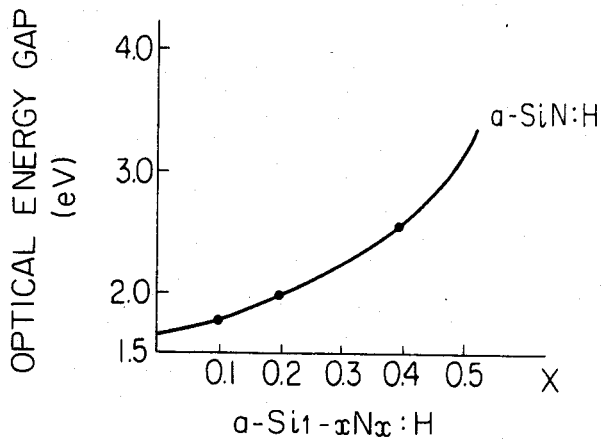
Figure 6:
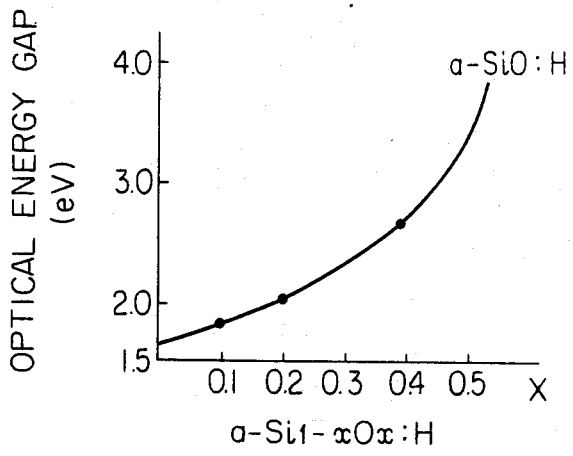

FIG. 6(*a*) shows the optical energy-gaps of a-SiNO:H, wherein the gap is satisfactorily great when the (N+O) content thereof is from 30 to 50%. FIG. 6(*b*) shows the optical energy-gap of a-SiN:H, and FIG. 6(*c*) shows that of a-SiO:H, wherein the gaps are also great when the N and O contents are from 30 to 50%.

It is also allowed to form an interlayer by making use of a-$Si_{1-z}(CO)_z$ in place of the a-$Si_{1-y}(NO)_y$:H, in which z is preferably $0.3 \leqq z \leqq 0.5$, or to contain the three elements, N, O and C, at the same time, in the interlayer.

The abovementioned a-SiC:H layer 45 is indispensable for modifying the surface of a photoreceptor to make an a-Si type photoreceptor excellent in practical use. Namely, an elecrophotographic receptor is made thereby capable of performing its basic operations such as that charges are to be held on the surface of the receptor and the surface potential is to be decayed by irradiating the receptor with light.

In this connection, the characteristics thereof in charging and light-decay repetition can extremely be stabilized and the excellent electric potential characteristics thereof can also be reproduced even if the receptor is allowed to stand for not shorter than one month, for example. The same effects may also be displayed when layer 45 is used in an a-SiN:H or a-SiO:H receptor. To the contrary, in the case of a photoreceptor having the surface made of a-Si:H, it is apt to be affected by moisture, the air, an ozoniferous atmosphere or the like, and the electric potential characteristics thereof are seriously changed with the passage of time. The described a-SiC:H layer 45 may be able to display excellent abrasion and heat resistance in the steps such as a developing, image transferring, cleaning, or the like step because the surface hardness thereof is high. It is, therefore, possible to apply thereto such a heating process as a tacky adhesion transfer process.

In order to display the abovementioned excellent effects collectively, it is essential to select the carbon composition of the a-SiC:H layer 45. Namely, it is preferred that the carbon atom content thereof is to be in an amount of from 50 to 80% of a total amount of Si+C which is regarded as 100%. From the abovementioned reasons, it is also desired that a content of C is to be made up to not less than 50%. Thus, a desired value of the abovementioned specific resistance may be obtained, and the optical energy-gap may become approximately not less than 2.5 eV and, therefore, irradiating rays of light may readily be able to reach a-Si:H layer 43, i.e., a charge-generating layer, in aid of the so-called optically transparent window-effect to visible and infrared rays of light. If such a C content is less than 50%, however, there is apt to occur such a disadvantage as a mechanical damage and the like and to lower the specific resistance down to a value not higher than the desired, and further to lower the photosensitivity of a photoreceptor because a part of the rays of light is absorbed in surface layer 45. If the C content exceeds 80%, a C content of the layer is increased so as to be apt to lose the characteristics of a semiconductor and further to lower the accumulation rate of the a-SiC:H layer when the layer is formed in a glow-discharge method, therefore, it is advisable to make the C content not higher than 80%. In the case that the layer 45 comprises either a-SiN:H or a-SiO:H also, it is preferred to adjust the N or O to the abovementioned value.

It is also important that the thickness of such an a-SiC:H layer 45 as described above is to be selected from the range of $400 \text{ Å} \leqq t \leqq 5000 \text{ Å}$ and more specifically of $400 \text{ Å} \leqq t < 2000 \text{ Å}$. In other words, when the thickness thereof exceeds 5000 Å, the residual voltage $V_R$ will become higher and the photosensitivity will also be lowered, so that the excellent characteristics thereof to serve as an a-Si type photoreceptor are apt to worsen. On the other hand, when the thickness thereof is less than 400 Å, the dark decay thereof will be increased and the photosensitivity thereof will also be lowered, because any voltage cannot be charged on the surface thereof due to the so-called tunnel-effect.

From the reasons mentioned above, it is preferred that a (C+N+O) content in interlayer 46 which is allowed to comprise 46*a* and 46*b* is to be not higher than 50%, and further that it is to be not less than 30% so as to keep satisfactorily the adhesive property thereof to charge-generating layer 43 and to make the characteristics such as specific resistance excellent.

It is advisable that the thickness of the interlayer is to be from 50 to 5000 Å. If the thickness thereof exceeds 5000 Å, the same phenomena are apt to occur as described above, and if it does not exceed 50 Å, the effects thereof to serve as an interlayer will be lost considerably.

In order to prevent the abovementioned charge-blocking layer 44 satisfactorily from being given an electron injection from support 41 into the charge-blocking layer 44, it is advisable that such a charge-blocking layer 44 be doped with a IIIa group element of periodic table such as boron at the flow rate of $B_2H_6/SiH_4$ — 100 to 5000 ppm by volume, in a glow-discharge decomposition to make the layer a p-type or p+ type. It is also advisable that the amount of impurities to be doped in charge-transport layer 42 is to be at a flow rate of $B_2H_6/SiH_4=2$ to 10 ppm by volume. When a photoreceptor is used for negatively charging, dope impurities may be provided to the blocking layer in a glow discharge decomposition at a flow rate of, for example, $PH_3/SiH_4=100$ to 1000 ppm by volume.

The thickness of charge-generating layer 43 is from 4 to 8 μm and more preferably from 5 to 7 μm. If the charge generating layer 43 is less than 4 μm in thickness, the photosensitivity thereof is insufficient, and if it exceeds 8 μm, the residual charge thereof is increased, so that the charge generating layer 43 will be unsatisfactory to put in practical use. It is advisable that charge transport layer 42 is to be from 10 to 30 μm in thickness. When a blocking layer 44 is less than 500 Å, the blocking effect thereof will be poor, and when it exceeds 2 μm, the charge transport function thereof is apt to be deteriorated.

It is also required that each of the abovementioned layers are to contain hydrogen. In particular, a hydrogen content of a photosensitive layer 43 is indispensable for compensating the dangling bond to improve both photoconductivity and charge holding capability of the photosensitive layer 43, and the amount thereof is preferably from 10 to 30%. The range of the hydrogen content is also the same as in the cases of the surface modifying layer 45, the charge blocking layer 44 and the charge transport layer 42. The impurities to be used for controlling the conductive type of the charge blocking layer 44, besides the aforementioned boron, include, for example, such a IIIa group element of periodic table as Al, Ga, In, Tl and the like so as to make the layer a p-type. To make such a layer an n-type, a Va group element of periodic table such as As, Sb and the like, besides the aforementioned phosphor, may be used.

Each of the carbon contents of the abovementioned charge transport layer 42 and the charge blocking layer 44 is from 5 to 30% and more preferably from 10 to 20%.

Figure 7:
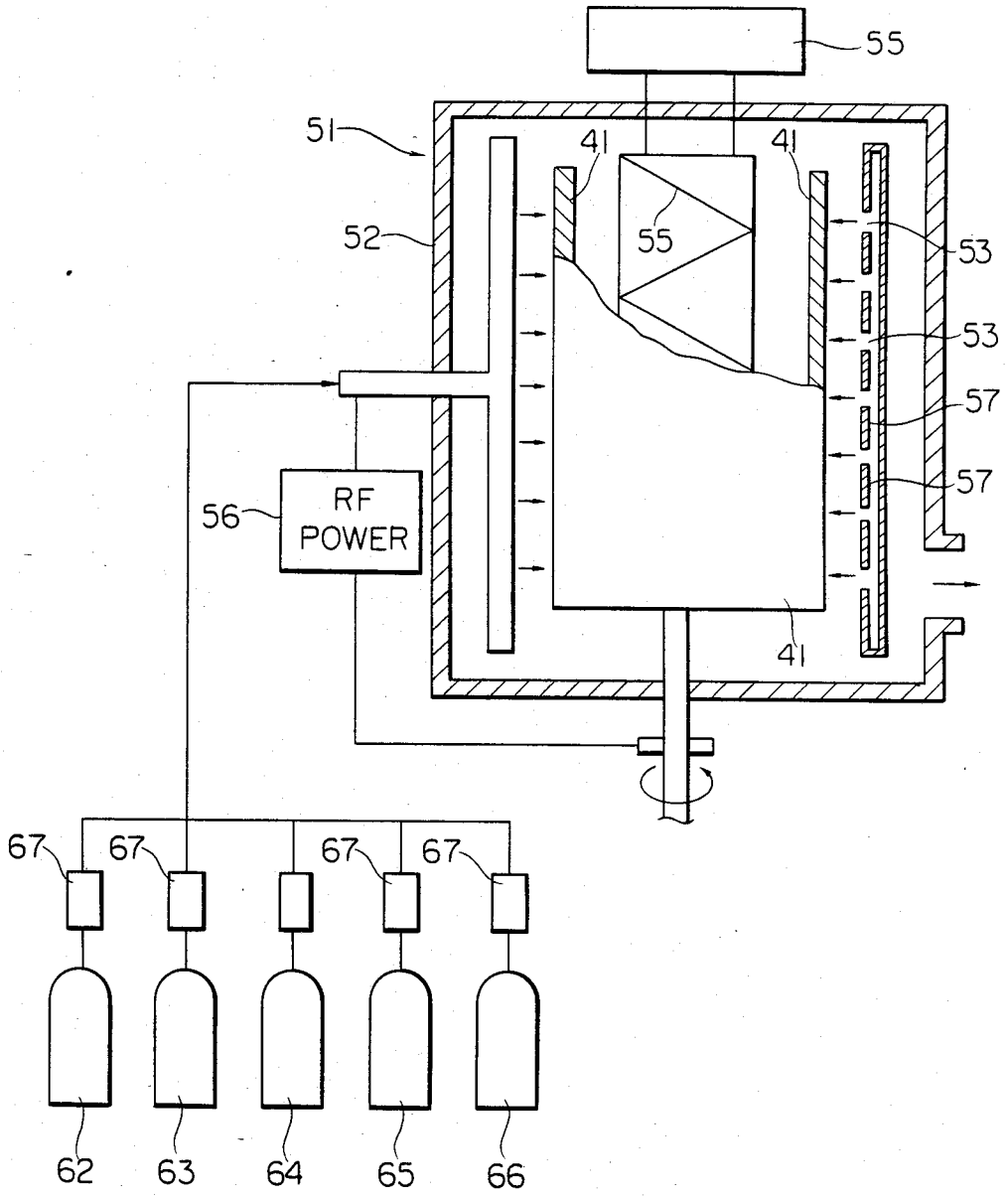

Next, how to prepare the abovementioned photoreceptors, a drum-type one, in particular, and the device (a glow discharge device) for preparing it will now be described with reference to FIG. 7.

In a vacuum chamber 52 of this device 51, a drum-type base plate 41 is vertically provided so as to be rotatable and heated from the inside thereof up to a certain temperature by a heater 55. A cylindrical high frequency electrode 57 attached with gas outlets 53 is arranged oppositely to the periphery of the base plate 41 so as to generate a glow-discharge between the electrode 57 and the base plate 41 from a high frequency power source 56. In FIG. 7, in addition, 62 is a supply source for $SiH_4$ or a gasified silicon compound, 63 is a supply source for $O_2$ or a gasified oxygen compound, 64 is a supply source for such a hydrocarbon as $CH_4$ and the like or gases of such a nitrogen compound as $NH_3$, $N_2$ or the like, 65 is a supply source for carrier gas such as Ar, 66 is a supply source for such a impurity gas as that of $B_2H_6$, and 67 are flowmeters. In the abovementioned glow discharge device, the surface of such a support as an aluminium base plate 41 is cleaned up and is then arranged to the inside of vacuum chamber 52, and a gas pressure inside the vacuum chamber 52 is adjusted to be $10^{-6}$ Torr and the gases are exhausted therefrom, and then the base plate 41 is heated up to a certain temperature, particularly from 100° to 350° C. and more preferably from 150° to 300° C. and is kept as it is. Next, $SiH_4$ or a gasified silicon compound, $CH_4$ ($NH_3$ or $N_2$), or $O_2$ is suitably introduced into the vacuum chamber 52 together with a highly purified inert gas to serve as a carrier gas, and a high frequency voltage such as 13.56 MHz is applied thereto under a reaction pressure of from 0.01 to 10 Torr, from the high frequency power source 56. Thereby, each of the abovementioned reaction gases are decomposed in a glow discharge method between the electrode 57 and the base plate 41, so that a-Si:H or a-SiC:H containing at least one of p-type a-SiC:H, a-SiC:H, a-Si:H, C, N and O is continuously accumulated over the base plate to serve as the abovementioned layers 44, 42, 43, 46 and 45, so as to correspond to the example shown in FIG. 1, for example.

In the abovementioned preparation process, the temperature of the support is kept at from 100° to 350° C. in the step of preparing an a-Si type layer on the support. Therefore, the layer quality of such a photoreceptor as mentioned above, (the electrical characteristics thereof, in particular) may be improved.

In order to compensate the aforementioned dangling bond in the course of forming each layer of the abovementioned a-Si type photoreceptor, fluorine is introduced thereinto in the form of $SiF_4$ or the like in place of or in combination with H which is mentioned above, so as to make it into a-Si:F, a-Si:H:F, a-SiN:F, a-SiN:H:F, a-SiC:F, a-SiC:H:F, a-SiCN:F, a-SiNO:F, a-SiCO:F or the like. In this case, an amount of fluorine is preferably from 0.5 to 10%.

The abovementioned preparation process is to be carried out in accordance with a glow discharge method. Besides the above method, the abovementioned photoreceptors may be prepared in such a method as a sputtering method, an ion-plating method, a method in which Si is evaporated in the state of introducing hydrogen activated or ionized by making use of a hydrogen discharging tube (including, particularly, the method described in Japanese Patent O.P.I. Publication No. 78413/1981 which is corresponded to Japanese Patent Application No. 152455/1979, each applied by the present inventors.)

The invention will now be described in detail further with reference to a typical example thereof.

On a drum-like aluminium support, there prepared an electrophotographic receptor having the structure illustrated in FIG. 1, in a glow discharge method. After the surface of a support, that is, the smooth surface of a drum-like aluminium base plate 41 for example, is cleaned up, the support is arranged to the inside of the vacuum chamber 52 shown in FIG. 7. Gases in the vacuum chamber 52 are so adjusted as to be $10^{-6}$ Torr in gas pressure and are then exhausted therefrom. At the same time, the base plate 41 is heated up to a certain temperature, that is, particularly from 100° to 350° C. and more preferably from 150° to 300° C., and is kept as it is. Next, highly purified Ar gas is introduced thereinto to serve as a carrier gas, and high frequency power of 13.56 MHz is applied thereto under a back pressure of 0.5 Torr, and then a preliminary discharge is tried for 10 minutes. After then, a p-type a-SiC:H layer 44 capable of displaying a charge blocking function is prepared on the support in such a manner that a reactive gas comprising $SiH_4$, $CH_4$ and $B_2H_6$ is introduced thereinto and an ($Ar+SiH_4+CH_4+B_2H_6$) mixed gas having a flow rate of $1:1:1:(1.5\times10^{-3})$ is decomposed in a glow discharging method. Next, a charge transport layer 42 is prepared thereon in such a manner that a flow rate of $B_2H_6$ to $SiH_4$ is adjusted to $1:10^{-6}$ and an accumulating rate is adjusted to 6 μm/hr to make up to a prescribed thickness. In succession, an a-Si:H layer 43 having a certain thickness is prepared thereon in such a manner that $B_2H$ and $CH_4$ are stopped to supply and $SiH_4$ is decomposed by discharge. Further, an interlayer 46 having a certain thickness is prepared thereon in such a manner that an ($Ar+SiH_4+CH_4$, $N_2$ or $O_2$) mixed gas having a flow rate of 4:1:6 is decomposed by glow discharge. Still further, a surface modifying layer 45 of a-SiC:H, a-SiN:H or a-SiO:H is provided thereon in such a manner that an ($Ar+SiH_4+CH_4$, $N_2$ or $O_2$) mixed gas is decomposed by glow discharge, so that an electrophotographic receptor is completed. The structure of the prepared photoreceptor may be summarized as follows:

(1) Surface modifying layer
(2) Inter layer
The above two layers are severally varied. {See FIGS. 8 through 12}, provided that the surface modifying layers shown in FIGS. 8 through 10 are a-SiC:H, and those shown in FIGS. 11 and 12 are a-SiN:H and a-SiO:H, respectively.
(3) a-Si:H charge generating layer:
Thickness = 5 μm
(4) a-SiC:H charge transport layer:
Thickness = 14 μm,
Carbon content = 12 atomic%
For positively charging: With B doping, in glow discharge decomposition, $[B_2H_6]/[SiH_4]=6$ vol ppm. For negatively charging: without doping.
(5) a-SiC:H charge blocking layer:
Thickness = 1 μm,
Carbon content = 12 atomic%
For positively charging: With B doping, in glow discharge decomposition, $[B_2H_6]/[SiH_4]=1500$ vol ppm.
For negatively charging: With P doping, in glow discharge decomposition, $[PH_3]/[SiH_4]=500$ vol ppm.
(6) Support: An aluminium cylinder (Mirror-surface polished).

Next, several kinds of tests were tried with each of the abovementioned photoreceptors.

<Scratch resistance>

Figure 13:
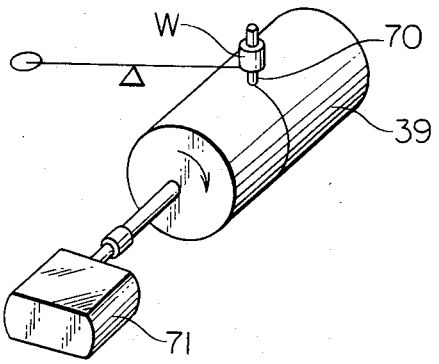
FIG. 13 illustrates a schematic diagram of a scratch-resistance tester.
Figure 14:
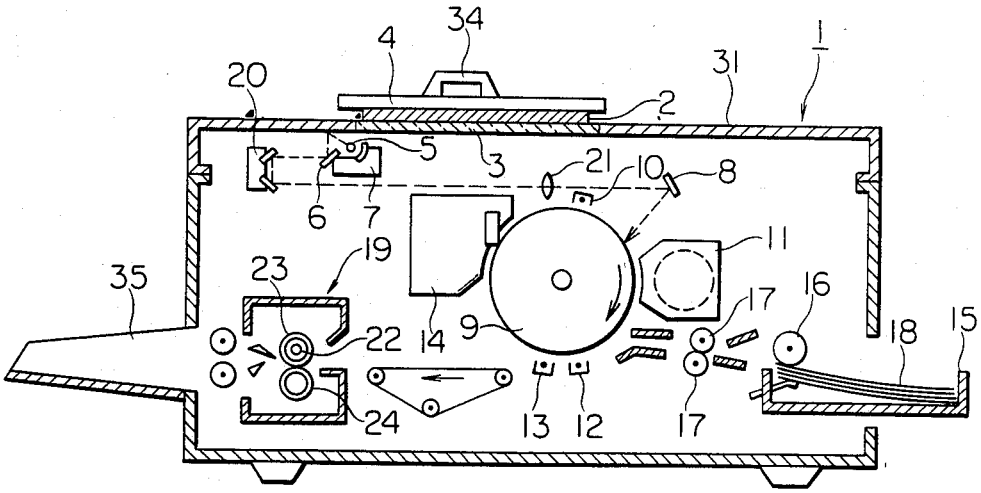
FIG. 14 illustrates a schematic cross-sectional view of a conventional type of electrophotographic copying machines.

As shown in FIG. 13, a weight W is placed on a diamond needle 70 having 0.3R being brought into vertical contact with the surface of a photoreceptor 39 and the photoreceptor 39 is rotated by a motor 71 so as to be scratched. Next, an image is reproduced by making use of an electrophotographic copying machine, U-Bix 1600 (manufactured by Konishiroku Photo Ind. Co., Ltd., Japan). It was checked up how many grams of the weight caused a white streak on the image, so as to determine the scratch resistance (g) of a photoreceptor.

<Blur>

A photoreceptor was accustomed for 24 hours to operate in an electrophotographic copying machine, U-Bix 4500, modified model, (manufactured by Konishiroku Photo Industry Co., Ltd.) under the conditions of 33° C. and RH at 80%, and was then run idle for a 1000 copy-cycle without contact with developers, paper sheets and blades, and images were tried to reproduce. The blur were judged by the following criteria:

: There is no blur at all, and 5.5 point characters and fine lines can be reproduced.
o: 5.5 point characters are thickened.
Δ: 5.5 point characters are defaced to scarcely read.
x: 5.5 point characters cannot be read.

<Residual voltage $V_R$ (V)>

A voltage still remaining on the surface of a photoreceptor when irradiating the surface thereof with electrically neutralized rays of light of 30 lux.sec having a peak of 400 nm, in measuring the voltage with a modified U-Bix 1600 copying machine.

<Image quality at a 200,000th copy time>

: There is neither white streak nor white spot on any reproduced image, and the images are sharp and excellent in resolving power and gradation.
o: White streaks or blurs occur only in a small part of a reproduced image.
Δ: White streaks and white spots partially occur on a reproduced image, and characters are partly hard to read because of an blur.
x: White streaks, white spots and blurs occur on an entire reproduced image.

All the results are shown in FIGS. 8 through 12, respectively, and the following facts as well as the results are proved:

(1) In the case of providing none of any interlayer and surface modifying layer:
In a scratch resistance test, a subject photoreceptor is apt to be damaged mechanically and resultantly white streaks and the like will occur on a reproduced image, because the scratch resistance thereof is poor. Also, an image blur will occur. Resultantly, the print repeatability thereof is extremely poor.
(2) In the case of providing without any interlayer but with an a-SiC:H, a-SiO:H or a-SiN:H surface modifying layer of 1500 Å in thickness:
Scratch resistance and the preventability of image either are unsatisfactory, and as a result the print repeatability is substantially poor.
(3) In the case of not providing with any interlayer but providing with an a-SiC:H, a-SiO:H or a-SiN:H surface modifying layer containing C, O or N = 60 atomic%, respectively, of which the thickness is changed:

The scratch resistance and the prevention of blurs are unsatisfactory, and the residual voltage is raised with increasing the thickness.

(4) In the case of laminating both of an a-Si type interlayer containing C+N+O=30 to 50 atomic% and an a-SiC:H, a-SiN:H or a-SiO:H surface modifying layer containing C, N or O=50 to 80 atomic%:

The scratch resistance is improved and any blur does not occur and further several hundreds of thousands of high-quality copies can be obtained, i.e., a hard print repeatability can be enjoyed.

(5) In the case that the a-Si type interlayer and the a-SiC:H, aSiN:H or a-SiO:H surface modifying layer are relatively thin in thickness:

There tends to lessen the scratch resistance and the effects of preventing blurs; and In the case that they are excessively thick:

The residual voltage thereof is apt to raise.

What is claimed is:

1. A photoreceptor comprising a support bearing thereon a charge transport layer comprising one selected from the group consisting of a-SiC:H, a-SiC:F and a-SiC:H:F, a charge generating layer comprising one selected from the group consisting of a-SiH, a-SiF and a SiH:F, an a-Si type surface modifying layer containing one selected from the group consisting of N, O and C, and an a-Si type consisting of N, O and C, the content of said at least one of N, O and C in said interlayer being less than in said surface modifying layer, said interlayer being interposed between said charge generating layer and said surface modifying layer.

2. The photoreceptor as claimed in claim 1, wherein said surface modifying layer comprises one selected from the group consisting of a-SiC:H, a-SiC:F and a-SiC:H:F.

3. The photoreceptor as claimed in claim 2, wherein said interlayer comprises one selected from the group consisting of a-SiC:H, a-SiC:F and a-SiC:H:F.

4. The photoreceptor as claimed in claim 3, wherein said surface modifying layer contains C in an amount of not less than 50 atomic% based on the total number of silicon and carbon atoms being 100 atomic%, and said interlayer contains C in an amount of not more than 50 atomic%.

5. The photoreceptor as claimed in claim 1, wherein said interlayer contains at least two selected from the group consisting of C, N and O.

6. The photoreceptor as claimed in claim 2, wherein the C content of said surface modifying layer is substantially more than in said interlayer and each of said layers contains at least two selected from the group consisting of C, N and O.

7. The photoreceptor as claimed in claim 6, wherein the C content of said surface modifying layer is from 50 to 80 atomic% based on the total number of Si and C atoms being 100 atomic%.

8. The photoreceptor as claimed in claim 1, wherein said surface modifying layer comprises one selected from the group consisting of a-SiN:H, a-SiN:F and a-SiN:H:F.

9. The photoreceptor as claimed in claim 8, wherein the N content of said surface modifying layer is substantially more than the total content of C, N and O in said interlayer.

10. The photoreceptor as claimed in claim 8, wherein the N content of said surface modifying layer is from 50 to 80 atomic% based on the total number of Si and N atoms being 100 atomic%.

11. The photoreceptor as claimed in claim 1, wherein said surface modifying layer comprises one selected from the group consisting of a-SiO:H, a-SiO:F and a-SiO:H:F.

12. The photoreceptor as claimed in claim 1, wherein the O content said surface modifying layer is substantially more than the total content of C, N and O in said interlayer.

13. The photoreceptor as claimed in claim 12, wherein the O content of said surface modifying layer is from 50 to 80 1 atomic% based on the total number of Si and O atoms being 100 atomic%.

14. The photoreceptor as claimed in claim 1, wherein the thickness of said surface modifying layer is from 400 to 5000 Å.

15. The photoreceptor as claimed in claim 1, wherein the thickness of said interlayer is not more than 5000 Å.

16. The photoreceptor as claimed in claim 1, wherein the thickness of said charge generating layer is from 4 to 8 μm.

17. The photoreceptor as claimed in claim 16, wherein the thickness of said charge generating layer is from 5 to 7 μm.

18. The photoreceptor as claimed in claim 1, wherein the C content of said charge transport layer is from 5 to 30 atomic% based on the total number of Si and C atoms being 100 atomic%.

19. The photoreceptor as claimed in claim 18, wherein the content in said charge transport layer is from 10 to 20 atomic%.

20. The photoreceptor as claimed in claim 1, wherein the thickness of said charge transport layer is from 10 to 30 μm.

21. The photoreceptor as claimed in claim 1, wherein a charge blocking layer comprising one selected from the group consisting of a-SiC:H, a-SiC:F and a-SiC:H:F is interposed between said charge transport layer and said support.

22. The photoreceptor as claimed in claim 21, wherein the C content of said charge blocking layer is from 5 to 30 atomic% and thickness is from 500 Å to 2 μm.

23. The photoreceptor as claimed in claim 22, wherein said charge blocking layer is heavily doped with a IIIa group element.

24. The photoreceptor as claimed in claim 1, wherein said charge transport layer is doped with a IIIa group element.

25. The photoreceptor as claimed in claim 1, wherein a plurality of said interlayers are provided.

26. The photoreceptor as claimed in claim 7, wherein the thickness of said surface modifying layer is from 400 to 5000 Å, the thickness of said interlayer is not more than 5000 Å, the thickness of said charge generating layer is from 5 to 7 μm, said charge transport layer contains from 10 to 20 atomic % or C based on the total number of Si and C atoms being 100 atomic %, the thickness of said charge transport layer is from 10 to 30 μm, and a charge blocking layer from 500 Å to 2 μm thick and comprising one selected from the group consisting of a-SiC:H, a-SiC:F and a-SiC:H:F is interposed between said charge transport layer and said support.

27. The photoreceptor as claimed in claim 10, wherein the thickness of said surface modifying layer is from 400 to 5000 Å, the thickness of said interlayer is not more than 5000 Å, the thickness of said charge generating layer is from 5 to 7 μm, said charge transport layer contains from 10 to 20 atomic % of C based on the total number of Si and C atoms being 100 atomic %, the thickness of said charge transport layer is from 10 to 30 μm, and a charge blocking layer from 500 Å to 2 μm thick and comprising one selected from the group consisting of a-SiC:H, a-SiC:F and a-SiC:H:F is interposed between said charge transport layer and said support.

28. The photoreceptor as claimed in claim 12, wherein the thickness of said surface modifying layer is from 400 to 5000 Å, the thickness of said interlayer is not more than 5000 Å, the thickness of said charge generating layer is from 5 to 7 μm, said charge transport layer contains from 10 to 20 atomic % of C based on the total number of Si and C atoms being 100 atomic %, the thickness of said charge transport layer is from 10 to 30 μm, and a charge blocking layer from 500 Åto 2 μm thick and comprising one selected from the group consisting of a-SiC:H, a-SiC:F and a-SiC:H:F is interposed between said charge transport layer and said support.

* * * * *